US011179737B1

(12) United States Patent
Nicolson

(10) Patent No.: US 11,179,737 B1
(45) Date of Patent: Nov. 23, 2021

(54) WATER DEFLECTION TOOL

(71) Applicant: Cash Nicolson, Paris, CA (US)

(72) Inventor: Cash Nicolson, Paris, CA (US)

( * ) Notice: Subject to any disclaimer, the term of this patent is extended or adjusted under 35 U.S.C. 154(b) by 0 days.

(21) Appl. No.: 16/904,287

(22) Filed: Jun. 17, 2020

Related U.S. Application Data

(60) Provisional application No. 62/862,506, filed on Jun. 17, 2019.

(51) Int. Cl.
*B05B 1/26* (2006.01)
*E03B 9/02* (2006.01)

(52) U.S. Cl.
CPC ..... *B05B 1/267* (2013.01); *E03B 9/02* (2013.01); *Y10T 137/5327* (2015.04)

(58) Field of Classification Search
CPC ..... B05B 1/267; E03B 9/02; Y10T 137/5327
See application file for complete search history.

(56) References Cited

U.S. PATENT DOCUMENTS

| | | | | |
|---|---|---|---|---|
| 1,364,163 | A * | 1/1921 | Wampler | B05B 1/267 239/516 |
| 1,751,345 | A * | 3/1930 | Matsui | B05B 1/262 239/275 |
| 2,900,139 | A * | 8/1959 | Hensley, Jr. | E03C 1/086 239/499 |
| 4,343,435 | A * | 8/1982 | Anderton | E03B 9/16 239/499 |
| 5,810,044 | A | 9/1998 | Saidi | |
| 6,045,059 | A * | 4/2000 | Weller | B05B 1/267 239/203 |
| 6,095,429 | A | 8/2000 | Killgrove et al. | |
| 6,116,525 | A | 9/2000 | Grimes | |
| 6,702,205 | B1 | 3/2004 | Abercrombie et al. | |
| 2011/0283786 | A1 | 11/2011 | Buckner et al. | |

* cited by examiner

*Primary Examiner* — Kevin R Barss
(74) *Attorney, Agent, or Firm* — Eric Karich; Karich & Associates

(57) ABSTRACT

A water deflection tool has a deflection plate with an inner surface and an outer surface that extend to a perimeter, the deflection plate having a height and a width that are adapted to catch and deflect the stream of water. A distal end of an elongate extension arm is fixedly attached to the outer surface of the deflection plate, the elongate extension arm further having a proximal end. The proximal end has a hitch mounting component that is adapted to attach to the vehicle.

6 Claims, 6 Drawing Sheets

WATER DEFLECTION TOOL

CROSS-REFERENCE TO RELATED APPLICATIONS

This application for a utility patent claims the benefit of U.S. Provisional Application No. 62/862,506, filed Jun. 17, 2019.

BACKGROUND OF THE INVENTION

Field of the Invention

This invention relates generally to water deflection tools, and more particularly to a water deflection tool that is adapted to be mounted on a vehicle.

Description of Related Art

The prior art teaches a variety of tools that are useful in deflecting water from a water hydrant.

Abercrombie, U.S. Pat. No. 6,702,205, teaches a hand-operated apparatus for redirecting flow of water exiting a fire hydrant support (i.e., when the fire hydrant has broken off of the support). The apparatus includes a flange connector for releasably connecting the flange connector to a flange of the fire hydrant support, a handle connected to the flange connector for positioning the flange connector, and a water diverter pivotally mounted on the flange connector engageable by water exiting the fire hydrant support. The engagement of the apparatus with the flange is what gives the apparatus enough stability to divert the powerful stream of water, despite the fact that it is held by a person; however, in practice, this can still be an extremely difficult job to accomplish by hand, given the enormous power of the water spraying from the hydrant.

A similar device is shown in Saidi, U.S. Pat. No. 5,810,044, which teaches another manually-operated device that is used to control water flowing from a fire hydrant. The device includes a cylindrical collar that is mounted around the fire hydrant, and an outlet pipe that directs the flow of water to a desired direction. A pair of handles extend outwardly from the collar, enabling two human users to position the device over the broken fire hydrant.

There are also a variety of hydrant diffusers, that are adapted to be attached to a fire hydrant that has not broken, but is to be opened for service. These diffusers are attached to the fire hydrant before the hydrant is opened, so are not particularly applicable to the present invention, but are included as a matter of general interest.

Grimes, U.S. Pat. No. 6,116,525, teaches a hydrant diffuser that includes a housing or box with one open end, slows and directs the flow of water from a hydrant when the hydrant has been opened to flush a water line. The diffuser can be mounted on any work truck or other vehicle having a class 3 trailer hitch receiver. A hose may be coupled to a fire hydrant to carry water to the diffuser. The other end of the hose is non-releasably attached to a 90-degree elbow which can be coupled to a flange bolted to the top of the diffuser box. The diffuser mounting to the truck includes means that allow the box outlet to be pointed straight back from the truck or in selected positions up to 90 degrees either to the right or left. A debris screen across the outlet end stops any rocks or other solid objects in the water stream. Other reference include US 2011/0283786 and U.S. Pat. No. 6,095,429.

The prior art teaches a tool for redirecting flow of water from a broken hydrant, wherein the apparatus is held by a person. However, the prior art does not teach a water deflection tool that can be attached to a vehicle. The present invention fulfills these needs and provides further advantages as described in the following summary.

SUMMARY OF THE INVENTION

The present invention teaches certain benefits in construction and use which give rise to the objectives described below.

The present invention provides a water deflection tool for attachment to a vehicle to deflect a stream of water. The water deflection tool comprises a deflection plate having an inner surface and an outer surface that extend to a perimeter, the deflection plate having a height and a width that are adapted to catch and deflect the stream of water. A distal end of an elongate extension arm is fixedly attached to the outer surface of the deflection plate, the elongate extension arm further having a proximal end. The proximal end has a hitch mounting component that is adapted to attach to the vehicle.

A primary objective of the present invention is to provide a water deflection tool having advantages not taught by the prior art.

Another objective is to provide a water deflection tool that may be attached to a vehicle for use, so that a person is not required to overcome the powerful stream of water manually.

A further objective is to provide a water deflection tool having an elongate extension arm that is fixedly attached to a deflection plate.

A further objective is to provide a water deflection tool having a deflection plate that is mounted at an angle to the expected stream of water, preferably having two stages having two different angles.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a water deflection tool 10 that is adapted to be mounted on a vehicle 12 such as a truck and positioned over a broken hydrant 14 (best shown in FIGS. 5-6) to divert the flow of water from the hydrant 14 so that it does not interfere with work on the hydrant 14.

Figure 1:
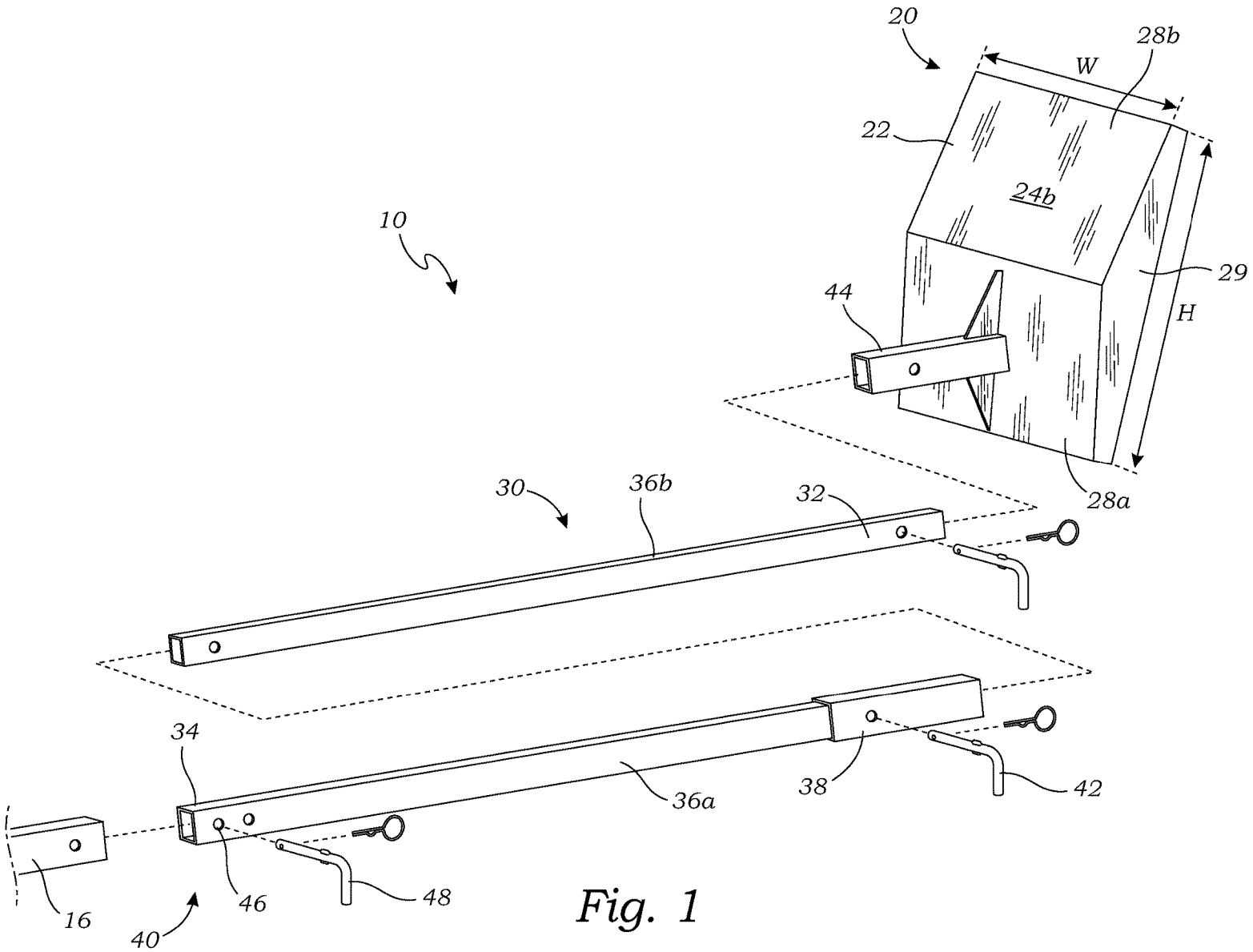
FIG. 1 is an exploded rear perspective view of a water deflection tool according to one embodiment of the present invention.
Figure 2:
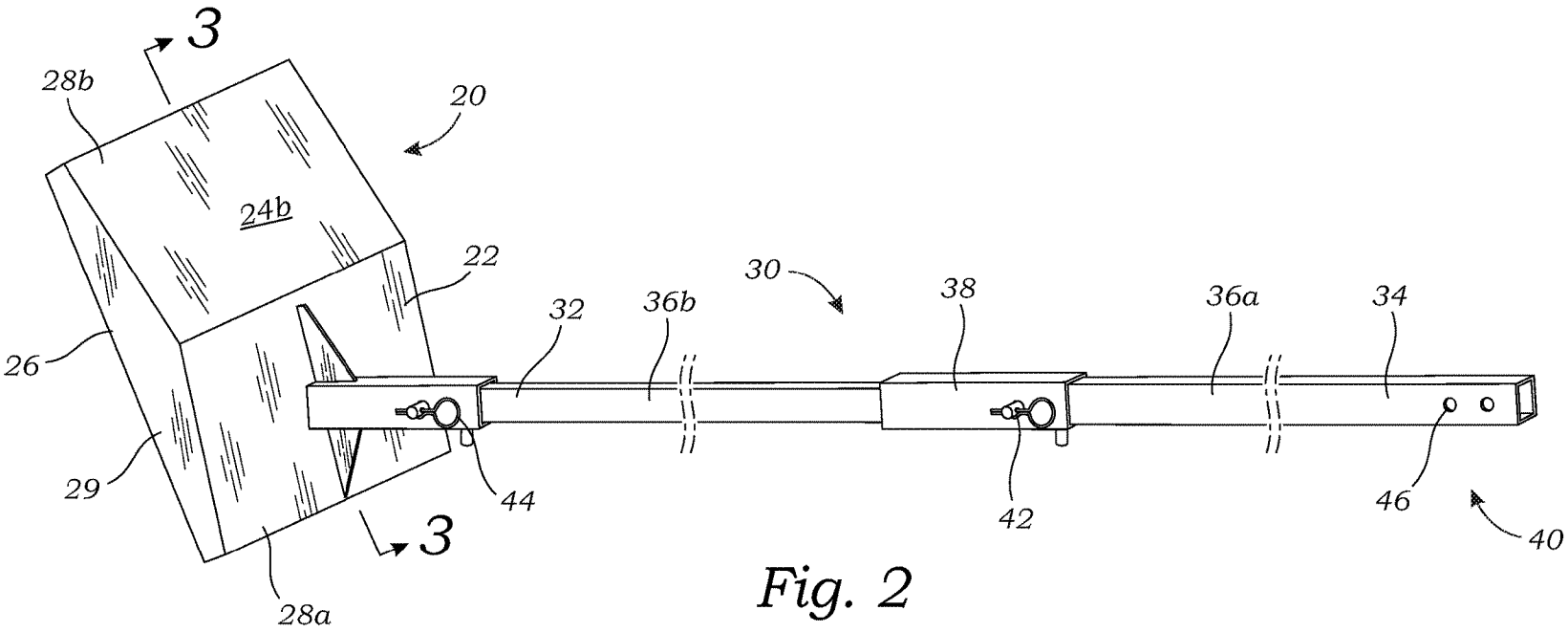
FIG. 2 is a rear perspective view thereof, illustrating the water deflection tool once assembled.
Figure 3:
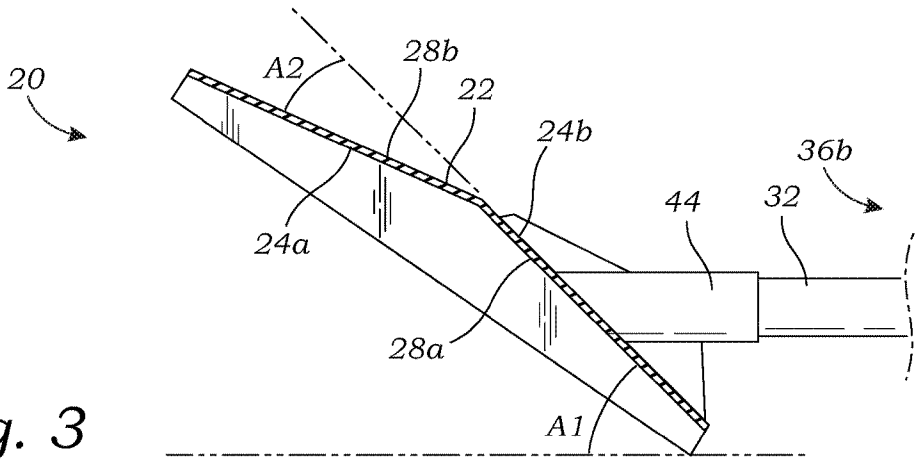
FIG. 3 is a sectional view thereof taken along line 3-3 in FIG. 2.

FIG. 1 is an exploded rear perspective view of the water deflection tool 10 according to one embodiment of the present invention. FIG. 2 is a rear perspective view thereof, illustrating the water deflection tool 10 once assembled. FIG. 3 is a sectional view thereof taken along line 3-3 in FIG. 2. As shown in FIGS. 1-3, the water deflection tool 10 includes a deflection plate 20 fixedly attached to a distal end 32 of an elongate extension arm 30, and a hitch mounting component 40 on a proximal end 34 of the elongate extension arm 30, each described in greater detail below.

In the embodiment of FIGS. 1-3, the deflection plate 20 has a sheet body 22 being constructed of rigid material (e.g., steel, reinforced plastic, or other suitably strong material) for deflecting the stream of water, as discussed in greater detail below. The sheet body 22 has an inner surface 24*a* (shown in FIGS. 3-4) and an outer surface 24*b* that extend to a perimeter 26. In this embodiment, the sheet body 22 has a rectangular construction having a height H and a width W that are great enough to catch and deflect the stream of water. In the present embodiment, the height H and width W are both between 1.5-4 feet, in this embodiment about 2 feet, although these dimensions could be adjusted according to the needs of one skilled in the art, and alternative shapes and sizes should be considered within the scope of the present invention.

In this embodiment, the deflection plate 20 includes a lower plate 28*a* that is fixedly attached to the distal end 32 of the elongate extension arm 30, and a higher plate 28*b* positioned above the lower plate 28*a*. As shown in FIG. 3, the lower plate 28*a* is positioned at a first angle A1 with respect to the axis of the elongate extension arm 30, for initial deflection of the water. In some embodiments, the first angle A1 is between approximately 30-75 degrees, in this embodiment about 45 degrees. The higher plate 28*b* is attached (e.g., pressed, bent, welded, etc.) to the lower plate 28*a* at a second angle A2 to the lower plate 28*a*. This angle is sufficient to further guide the stream of water away from a worker, and is between approximately 10-30 degrees, in this embodiment about 22 degrees.

In the embodiment of FIGS. 1-3, the deflection plate 20 further includes side walls 29 which provide structural strength and which further operate to direct the flow of water in a desired direction, as discussed in greater detail below. The size, shape, and dimensions of the side walls 29 could be adjusted according to the needs of one skilled in the art, and alternative shapes and sizes should be considered within the scope of the present invention.

While one embodiment of the deflection plate 20 is illustrated herein, those skilled in the art may devise a wide range of structures (e.g., plates, tubes, curved structures, etc.) that would function to divert water in a suitable manner consistent with the teachings of this invention, and such alternative constructions should be considered within the scope of the present invention.

Figure 7:
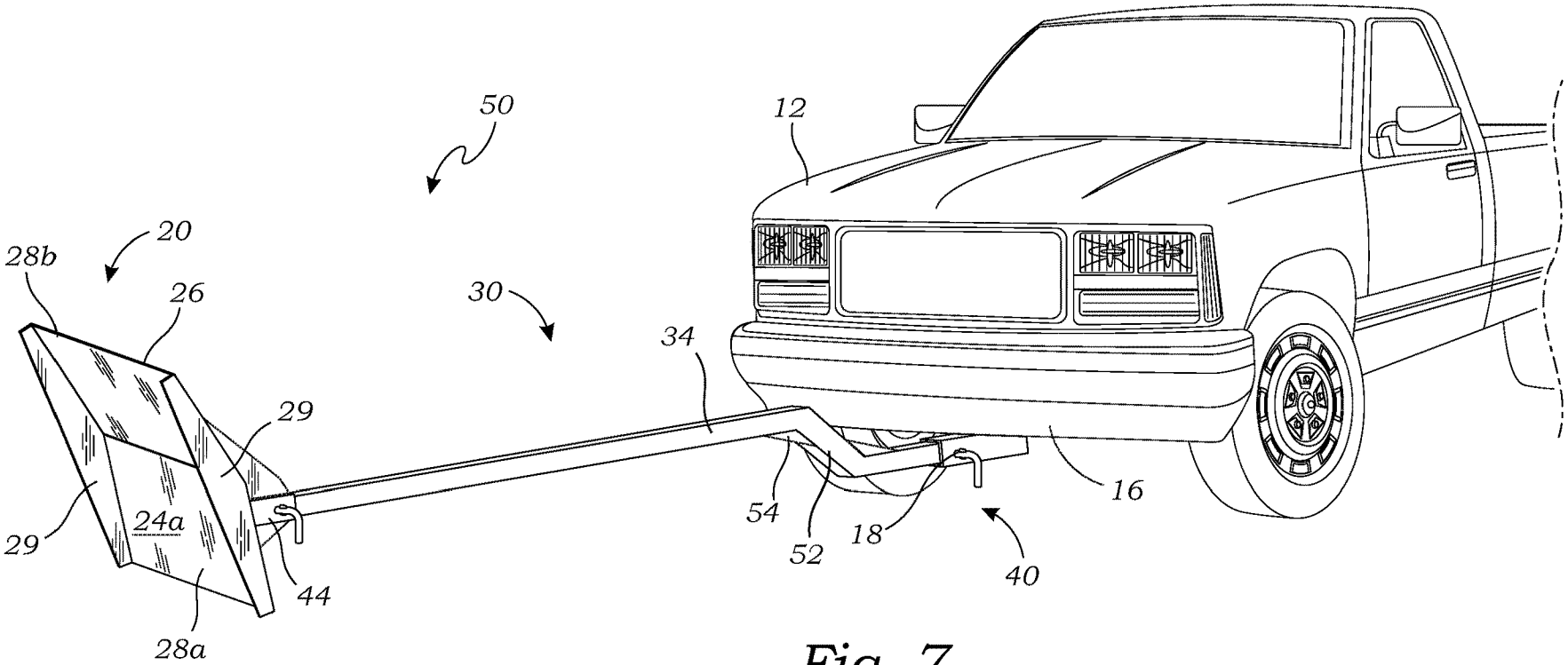
FIG. 7 is a front perspective view of a second embodiment of the water deflection tool installed on the trailer hitch of the truck.

As shown in FIGS. 1-3, the elongate extension arm 30 is provided to support the deflection plate 20 a distance from the vehicle. In this embodiment, the elongate extension arm 30 is a strong, rigid structure such as a rod, tube, shaft, or similar construction, which holds the deflection plate 20 a suitable distance for use. In some embodiments, the elongate extension arm 30 is may be reinforced with braces 54 (as shown in FIG. 7 and discussed below) or similar structures for further strength. In some embodiments, the elongate extension arm 30 includes two or more sections, so that the elongate extension arm 30 may be disassembled for transport and storage. However, other embodiments and as shown in FIG. 7, the elongate extension arm may be in a single rigid construction. In this embodiment, the elongate extension arm 30 includes a first tubular component 36*a* and a second tubular component 36*b* which engage each other (e.g., telescopically, frictionally, hingeably, etc.) so that they may be extended to a full length, or disassembled, or collapsed into a shorter length.

In this embodiment, the first tubular component 36*a* includes a receiver 38 that is sized and shaped to receive the second tubular component 36*b*, wherein they can be locked with a locking mechanism 42, in this case a locking pin. The lower deflection plate 28 may also include a similar attachment mechanism 44 for removably receiving the second tubular component 36*b*. Alternatively, these components 36*b* and 20 may be permanently joined (e.g., via welding, different molds, etc.), or attached in other manners.

The first and second tubular components 36*a* and 36*b* may include a cross sectional shape which enables them to interconnect. In this embodiment, they have a square cross section, or prevent rotation of the two components 36*a* and 36*b* with respect to each other; however, other shapes may be used, including a round shape if other structures are provided to prevent rotation.

In this embodiment, the elongate extension arm 30, in this case the first tubular component 36*a*, further includes the hitch mounting component 40, which is adapted to be mounted to the vehicle, such as via a trailer hitch receiver 16. In this embodiment, the hitch mounting component 40 is formed by the end of the elongate extension arm 30, which is sized and shaped to fit into a trailer hitch receiver 16 (shown in FIG. 4), and includes at least one aperture 46 for receiving a locking hitch pin 48, as is commonly used for attaching trailer hitches. However, the hitch mounting component 40 may have alternative constructions for mounting the elongate extension arm 30 onto the vehicle, including any form of receiver or mounting post which may be mounted on the vehicle using methods known in the art.

Figure 4:
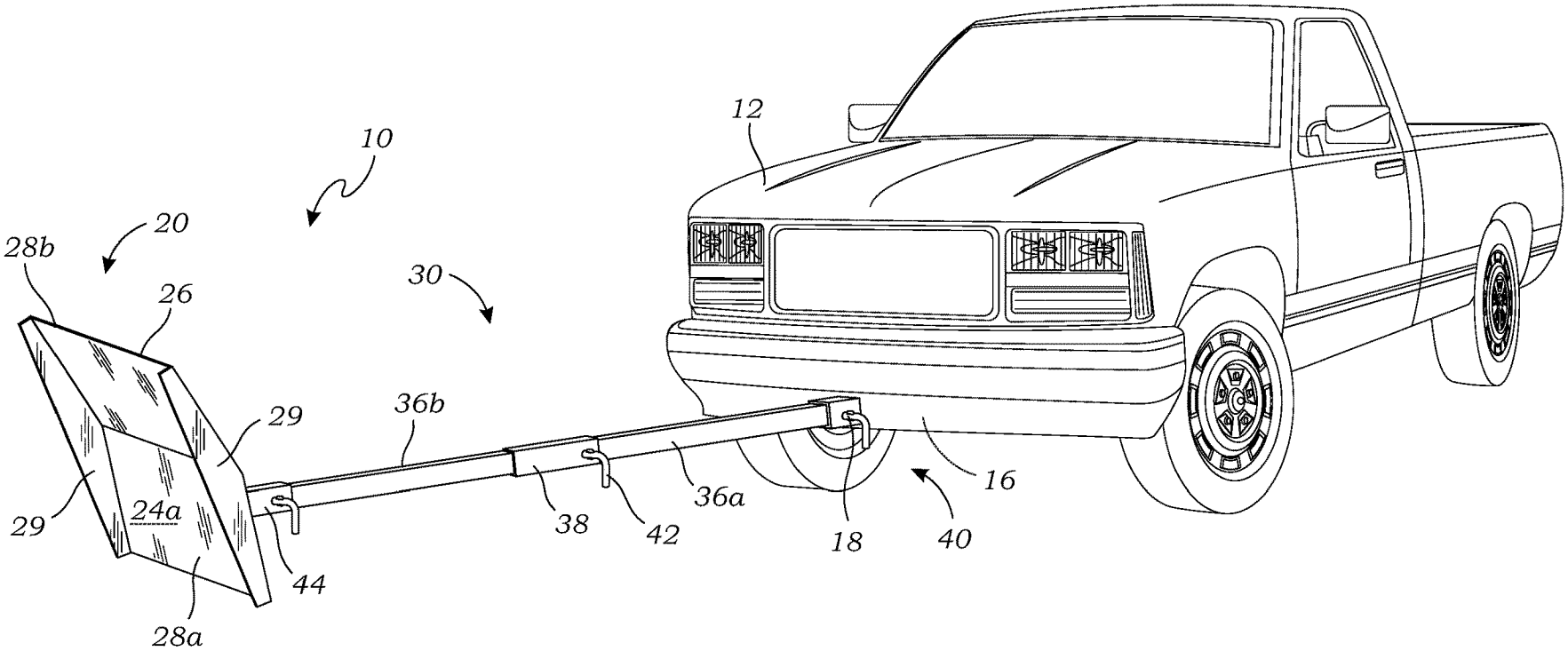
FIG. 4 is a front perspective view of the water deflection tool installed on a trailer hitch of a truck.

FIG. 4 is a front perspective view of the water deflection tool 10 installed on the trailer hitch receiver 16 of the truck 12. In this embodiment, the trailer hitch receiver 16 is mounted on the front of the truck 12, to facilitate ease of use; however, the water deflection tool 10 may also attach to the trailer hitch receiver 16 if it were mounted on the back of the truck 12, as is more common. Furthermore, as discussed above, the hitch mounting component 40 may be adapted to attach to the vehicle 12 in alternative methods which may be devised by those skilled in the art, and such alternatives should be considered within the scope of the present invention. The use of the trailer hitch receiver 16 is currently preferred only because such devices are commonly already installed on suitable vehicles, so this provides a suitably strong and rugged attachment point without requiring any further installations onto the vehicle 12.

Figure 5:
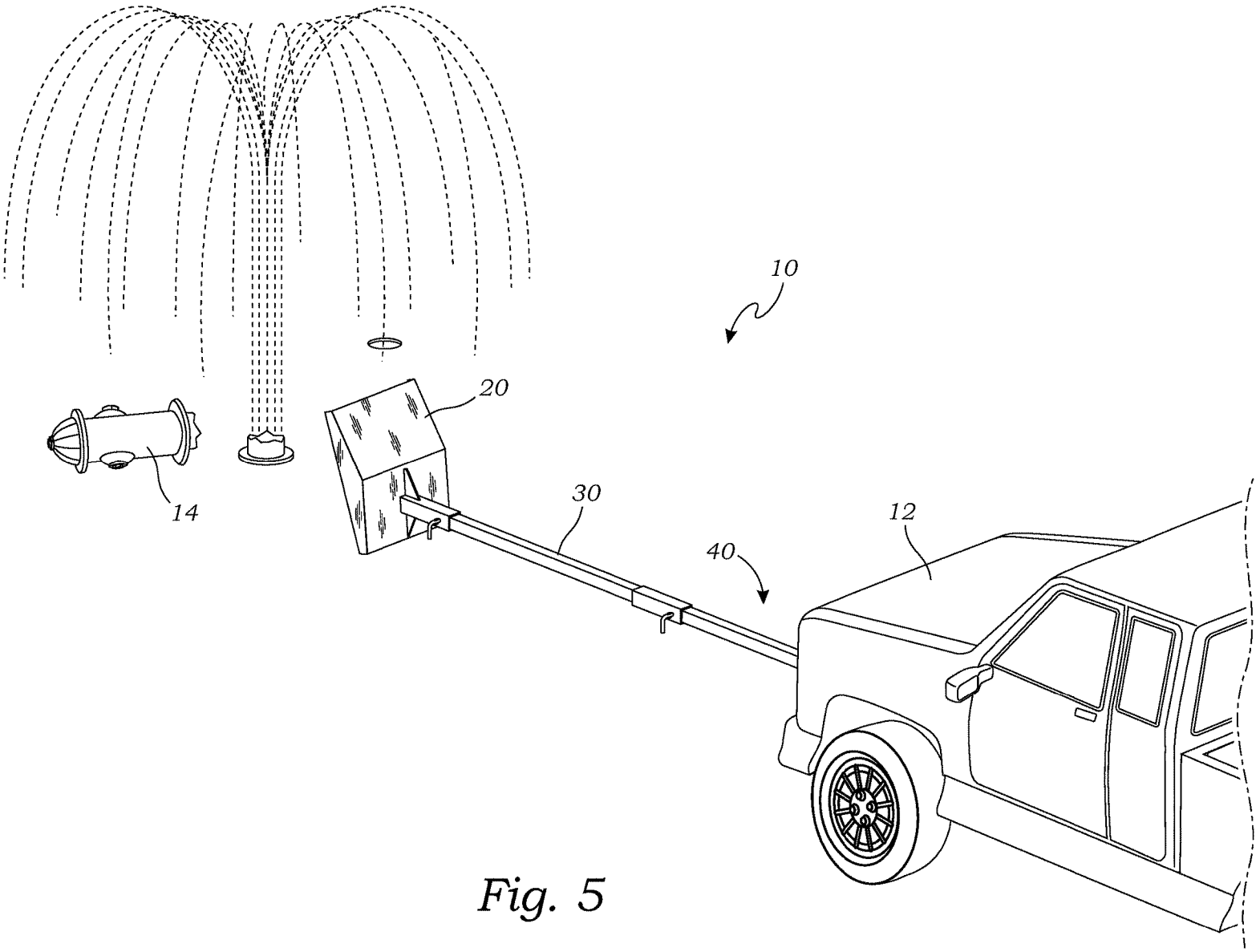
FIG. 5 is a perspective view of a broken hydrant, illustrating a large flow of water interfering with work on the broken hydrant.

FIG. 5 is a perspective view of the hydrant 14, wherein the hydrant 14 is broken and a large flow of water is interfering with work on the broken hydrant 14. As shown in FIG. 5, the large flow of water can physically interfere with work on the broken hydrant 14. It may also flow into power lines, which may pose a significant safety hazard to workers. For these and other reasons, it is often necessary to divert this flow of water, preferably from a safe distance.

Figure 6:
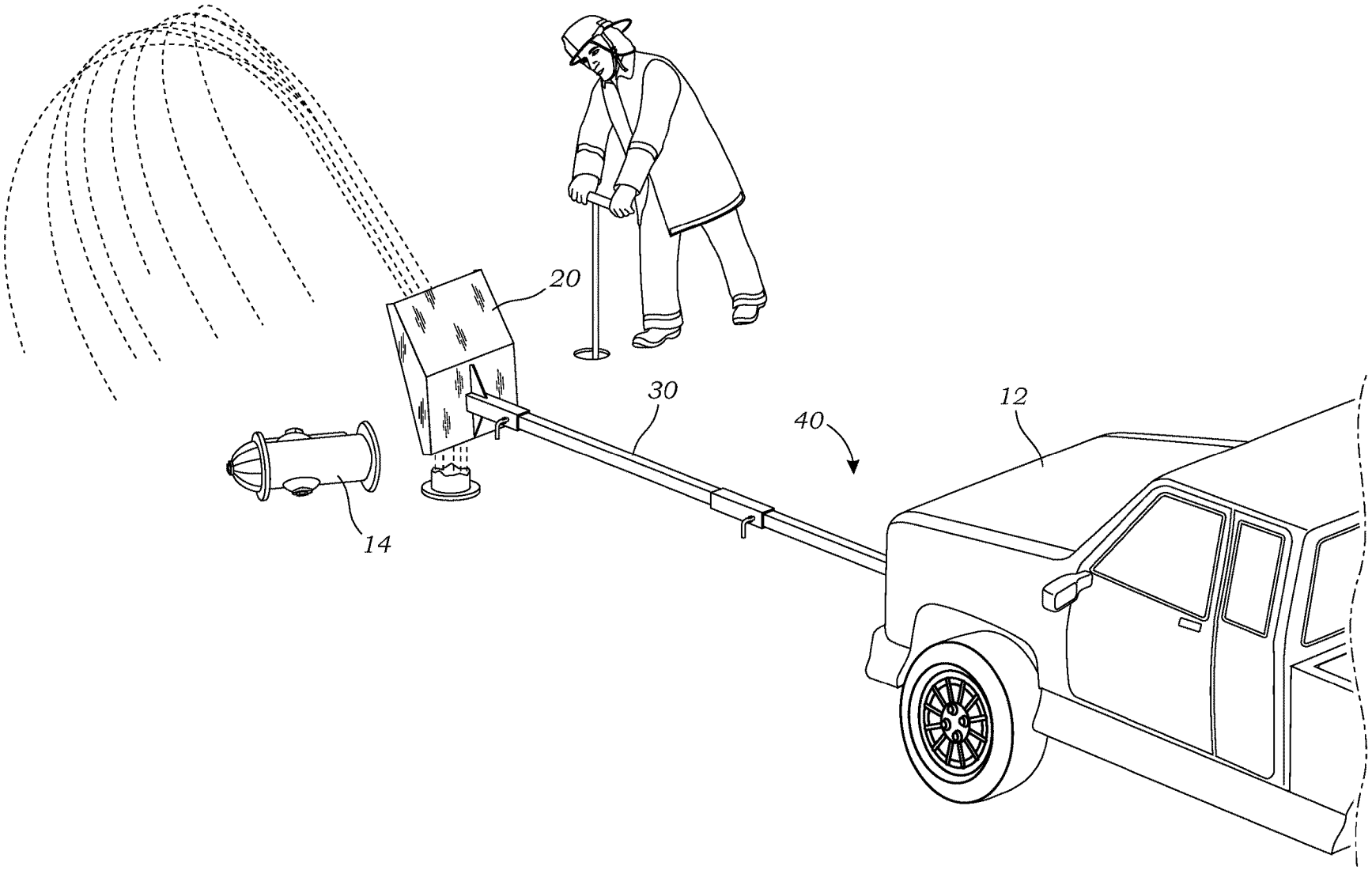
FIG. 6 is a perspective view of the water deflection tool being positioned over the broken hydrant to divert the flow of water so that it does not interfere with work on the broken hydrant.

FIG. 6 is a perspective view of the water deflection tool 10 being positioned over the broken hydrant 14 to divert the flow of water so that it does not interfere with work on the broken hydrant 14. As shown in FIG. 6, the water deflection tool 10 may be positioned by driving the vehicle 12 into position, while the worker remains safely inside the vehicle 12. The combination of the vehicle 12 and the water deflection tool 10 provide mobility, and also enough physical strength to handle the powerful flow of water, without potential injury to the workers.

FIG. 7 is a front perspective view of a second embodiment 50 of the water deflection tool installed on the trailer hitch 16 of the truck 12. As shown in FIG. 7 and discussed above, in this embodiment, the elongate extension arm 30 is a single construction, without the first and second tubular components 36*a* and 36*b*. The elongate extension arm 30 is further reinforced with the braces 54 on a "Z-shaped" section 52 of the proximal end 34 of the elongate extension arm 30. The "Z-shaped" section 52 may allow the elongate extension arm 30 to conveniently angle away from the vehicle 12 (e.g., farther away from the ground), as well as provide structural strength. Variations of this section 52 may be implemented according to the teachings of the present invention, such as a smaller angle, more joints, or other structures or ornament which may assist in the water deflection process.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A water deflection tool for attachment to a vehicle to deflect a stream of water, the water deflection tool comprising:

a deflection plate having an inner surface and an outer surface that extend to a perimeter, the deflection plate having a height and a width that are adapted to catch and deflect the stream of water;

an elongate extension arm having a proximal end and a distal end, the distal end being fixedly attached to the outer surface of the deflection plate;

a hitch mounting component on the proximal end of the elongate extension arm, the hitch mounting component being adapted to attach to the vehicle;

wherein the sheet body of the deflection plate is generally rectangular in construction; and wherein the height and the width are each between 1.5-4 feet.

2. The water deflection tool of claim 1, wherein a square cross-section of the elongate extension arm is sized and shaped to fit into a standard trailer hitch receiver, and includes at least one aperture for receiving a locking hitch pin.

3. A water deflection tool for attachment to a vehicle to deflect a stream of water, the water deflection tool comprising:

a deflection plate having an inner surface and an outer surface that extend to a perimeter, the deflection plate having a height and a width that are adapted to catch and deflect the stream of water;

an elongate extension arm having a proximal end and a distal end, the distal end being fixedly attached to the outer surface of the deflection plate;

a hitch mounting component on the proximal end of the elongate extension arm, the hitch mounting component being adapted to attach to the vehicle; and wherein the elongate extension arm includes a first tubular component and a second tubular component which engage each other so that they may be extended to a full length, or disassembled, or collapsed into a shorter length.

4. The water deflection tool of claim 3, wherein the first tubular component includes a receiver that is sized and shaped to receive the second tubular component, wherein they may be locked with a locking mechanism.

5. The water deflection tool of claim 3, wherein the second tubular component has a locking mechanism for engaging the deflection plate.

6. A water deflection tool for attachment to a vehicle to deflect a stream of water, the water deflection tool comprising:

a deflection plate having an inner surface and an outer surface that extend to a perimeter, the deflection plate having a height and a width that are adapted to catch and deflect the stream of water;

an elongate extension arm having a proximal end and a distal end, the distal end being fixedly attached to the outer surface of the deflection plate; and a hitch mounting component on the proximal end of the elongate extension arm, the hitch mounting component being adapted to attach to the vehicle;

wherein the deflection plate includes a lower plate that is attached to the distal end of the elongate extension arm, and a higher plate positioned above the lower plate, and wherein the deflection plate further includes side walls;

wherein the lower plate is positioned at a first angle with respect to an axis of the elongate extension arm, for initial deflection of the stream of water, and the higher plate is attached to the lower plate at a second angle to further guide the stream of water away from a user; and wherein the first angle is between 30-75 degrees, and the second angle is between 10-30 degrees.

* * * * *